US008934831B2

(12) United States Patent
Choi

(10) Patent No.: US 8,934,831 B2
(45) Date of Patent: Jan. 13, 2015

(54) IMAGE FORMING APPARATUS HAVING PRINTING PATH GUIDE UNIT

(75) Inventor: Dong Ha Choi, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 413 days.

(21) Appl. No.: 12/923,226

(22) Filed: Sep. 9, 2010

(65) Prior Publication Data

US 2011/0070002 A1 Mar. 24, 2011

(30) Foreign Application Priority Data

Sep. 18, 2009 (KR) ..... 10-2009-88542

(51) Int. Cl.
*G03G 15/00* (2006.01)

(52) U.S. Cl.
CPC ..... *G03G 15/657* (2013.01); *G03G 15/6573* (2013.01)
USPC ..... 399/397; 399/400

(58) Field of Classification Search
CPC ..... G03G 15/657; G03G 2215/00413; G03G 15/6573
USPC ..... 399/322, 400, 397
See application file for complete search history.

(56) References Cited

U.S. PATENT DOCUMENTS

| | | | | |
|---|---|---|---|---|
| 4,769,670 | A * | 9/1988 | Nishise | 399/397 |
| 5,749,035 | A * | 5/1998 | Ban et al. | 399/397 |
| 5,839,028 | A * | 11/1998 | Nomura et al. | |
| 6,330,419 | B1 * | 12/2001 | Sano et al. | 399/322 |
| 7,020,431 | B2 * | 3/2006 | Sahara | 399/400 |
| 2003/0011126 | A1 * | 1/2003 | Miyazawa | |
| 2004/0131399 | A1 * | 7/2004 | Sahara | 399/322 |
| 2006/0099004 | A1 * | 5/2006 | Hasegawa et al. | 399/400 |
| 2009/0010696 | A1 * | 1/2009 | Yang | |

FOREIGN PATENT DOCUMENTS

| | | | | |
|---|---|---|---|---|
| JP | 2000194241 | A * | 7/2000 | G03G 21/10 |
| JP | 2002323823 | A * | 11/2002 | G03G 15/20 |

* cited by examiner

*Primary Examiner* — David Gray
*Assistant Examiner* — Laura Roth
(74) *Attorney, Agent, or Firm* — Staas & Halsey LLP

(57) ABSTRACT

An image forming apparatus, having a developing unit and a fusing unit are arranged to horizontally face the developing unit. A printing path between the developing unit and the fusing unit includes a guide unit having a downward slope to guide a printing medium immediately having passed through the transfer nip and an upward slope to guide the printing medium approaching the fusing nip. The fusing nip is located lower than the transfer nip.

12 Claims, 4 Drawing Sheets

IMAGE FORMING APPARATUS HAVING PRINTING PATH GUIDE UNIT

CROSS-REFERENCE TO RELATED APPLICATIONS

This application claims the benefit of Korean Patent Application No. 2009-0088542, filed on Sep. 18, 2009 in the Korean Intellectual Property Office, the disclosure of which is incorporated herein by reference.

BACKGROUND

1. Field

Embodiments relate to an image forming apparatus suitable to prevent pollution of a rear end of a printing medium when the printing medium, having passed through a developing unit, approaches a fusing unit.

2. Description of the Related Art

Generally, image forming apparatuses are devised to form an image on a printing medium according to inputted image signals. Examples of image forming apparatuses include printers, copiers, facsimiles, and so-called multi-functional devices that combine some of the functionalities of the aforementioned devices.

An electro-photographic image forming apparatus includes a paper supply unit in which a plurality of printing media is stored, a developing unit to form an image on a printing medium, supplied sheet by sheet from the paper supply unit, using developer, and a paper discharge unit to discharge the printing medium, on which the image has been completely formed, to the outside.

In the developing unit, an electrostatic latent image is formed on a surface of the photosensitive body as light scans the photosensitive body that has been charged with a predetermined electric potential, and developer is fed to the electrostatic latent image, developing the electrostatic latent image into a visible image.

The developer image formed on the photosensitive body is transferred to the printing medium via a transfer roller and subsequently, the transferred developer image on the printing medium is fused to the printing medium while passing through a fusing unit.

A region between the developing unit and the fusing unit is a non-fusing region in which some of the developer scattered over the printing medium is present as fine developer powder. The fine developer powder may pollute a lower end of a housing of the developing unit.

In the meantime, as the printing medium passes through the fusing unit, the printing medium is pressed between a heating roller and a press roller having an elastic layer. In this case, if the elastic layer of the press roller is deformed, it may cause a rear end of the printing medium to be raised.

The raised rear end of the printing medium may come into contact with the polluted lower end of the housing of the developing unit and consequently, the rear end of the printing medium may be polluted.

Moreover, in a state wherein the developer image is not yet completely fused to the printing medium, the developer image may be deformed as the rear end of the printing medium comes into contact with the lower end of the housing of the developing unit.

SUMMARY

Therefore, it is an aspect of the present invention to provide an image forming apparatus to prevent pollution of a printing medium.

Additional aspects will be set forth in part in the description which follows and, in part, will be apparent from the description, or may be learned by practice of embodiments.

In accordance with one aspect, an image forming apparatus includes a body, a transfer nip defined by a photosensitive body on which an electrostatic latent image is formed and a transfer roller used to transfer a visible image formed on the photosensitive body to a printing medium, and a fusing nip defined by a heating member having a heating source and a press roller adapted to press the printing medium toward the heating member, the transfer nip and the fusing nip being horizontally arranged so that the fusing nip is located lower than the transfer nip, and the fusing nip being provided to deliver the printing medium upward.

A printing path, along which the printing medium is delivered, between the transfer nip and the fusing nip may include a downward slope to guide the printing medium immediately having passed through the transfer nip and an upward slope to guide the printing medium approaching the fusing nip.

The fusing nip may be closer to an intersection point, where a common tangent of the transfer nip and a common tangent of the fusing nip meet, than the transfer nip.

The image forming apparatus may further include an intersection point where a common tangent of the transfer nip and a common tangent of the fusing nip meet, and a length of a fusing nip tangent between the fusing nip and the intersection point may be shorter than a length of a transfer nip tangent between the transfer nip and the intersection point.

The length of the transfer nip tangent and the length of the fusing nip tangent may satisfy the following relation: $1.5 \leq L1/L2 \leq 3.0$ where, L1 is the length of the transfer nip tangent, and L2 is the length of the fusing nip tangent.

An upper one of centers of the heating member and the press roller defining the fusing nip may be arranged closer to the transfer nip than a lower one with respect to an x-axis direction.

An upper one of centers of the photosensitive body and the transfer roller defining the transfer nip may be arranged closer to the fusing nip than a lower one with respect to an x-axis direction.

The image forming apparatus may further include a paper supply unit provided in a lower region of the body for storage and supply of the printing medium.

The image forming apparatus may further include a paper discharge unit provided above the fusing nip to discharge the printing medium, having passed through the fusing nip, out of the body.

In accordance with another aspect, an image forming apparatus includes a body, a paper supply unit for storage and supply of a printing medium, a transfer nip defined at a contact region between a photosensitive drum, on which an electrostatic latent image is formed, and a transfer roller used to transfer a visible image formed on the photosensitive drum to the printing medium, a fusing nip located lower than the transfer nip and defined at a contact region between a heating roller and a press roller adapted to press the printing medium toward the heating roller, and a paper discharge unit to discharge the printing medium, having passed through the fusing nip, out of the body, the fusing nip being closer to an intersection point, where a tangent of the transfer nip and a tangent of the fusing nip meet, than the transfer nip.

The paper supply unit may be arranged in a lower region of the body, and the paper discharge unit may be arranged in an upper region of the body.

A printing path of the printing medium may be an 'S'-shaped path.

A length of a transfer nip tangent between the transfer nip and the intersection point may be longer than a length of a fusing nip tangent between the fusing nip and the intersection point.

The length of the transfer nip tangent and the length of the fusing nip tangent may satisfy the following relation: $1.5 \leq L1/L2 \leq 3.0$ where, L1 is the length of the transfer nip tangent, and L2 is the length of the fusing nip tangent.

In accordance with a further aspect, an image forming apparatus includes a transfer nip defined by a photosensitive drum and a transfer roller, and a fusing nip defined by a heating roller and a press roller, the transfer nip and the fusing nip being horizontally arranged so that the fusing nip is located lower than the transfer nip, and an upper one of centers of the heating roller and the press roller defining the fusing nip is arranged closer to the transfer nip than a lower one with respect to an x-axis direction.

An upper one of centers of the photosensitive drum and the transfer roller defining the transfer nip may be arranged closer to the fusing nip than a lower one with respect to an x-axis direction.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
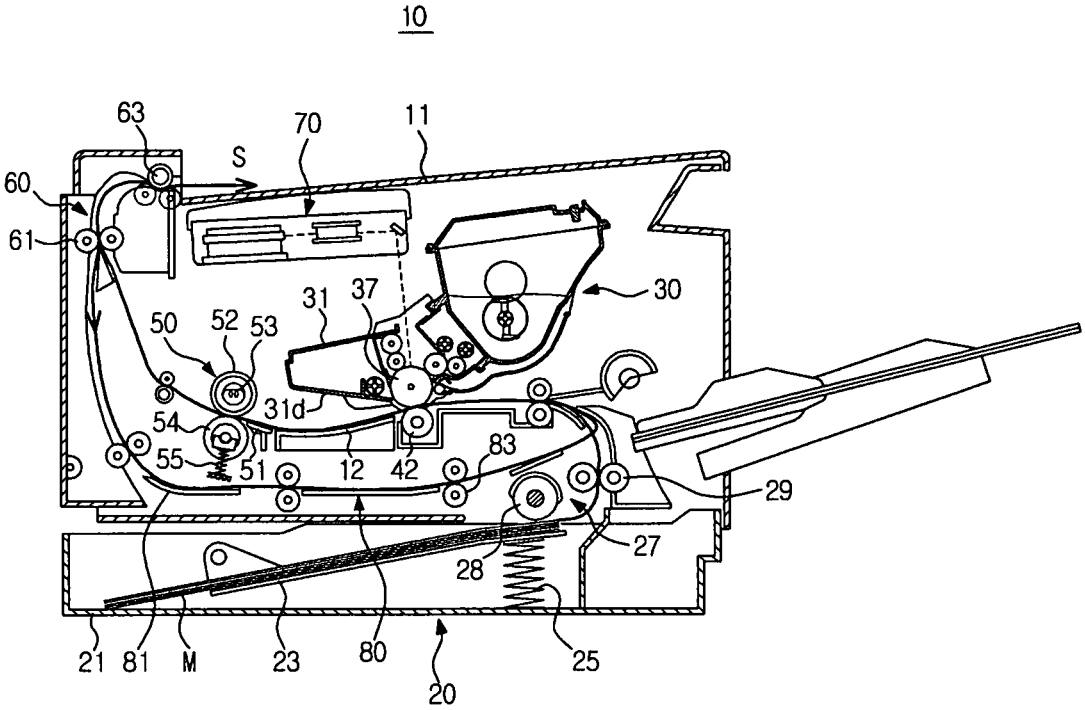
FIG. 1 is a sectional view illustrating a configuration of an image forming apparatus according to an embodiment.

Reference will now be made in detail to the embodiments of the present invention, examples of which are illustrated in the accompanying drawings, wherein like reference numerals refer to like elements throughout.

Figure 2:
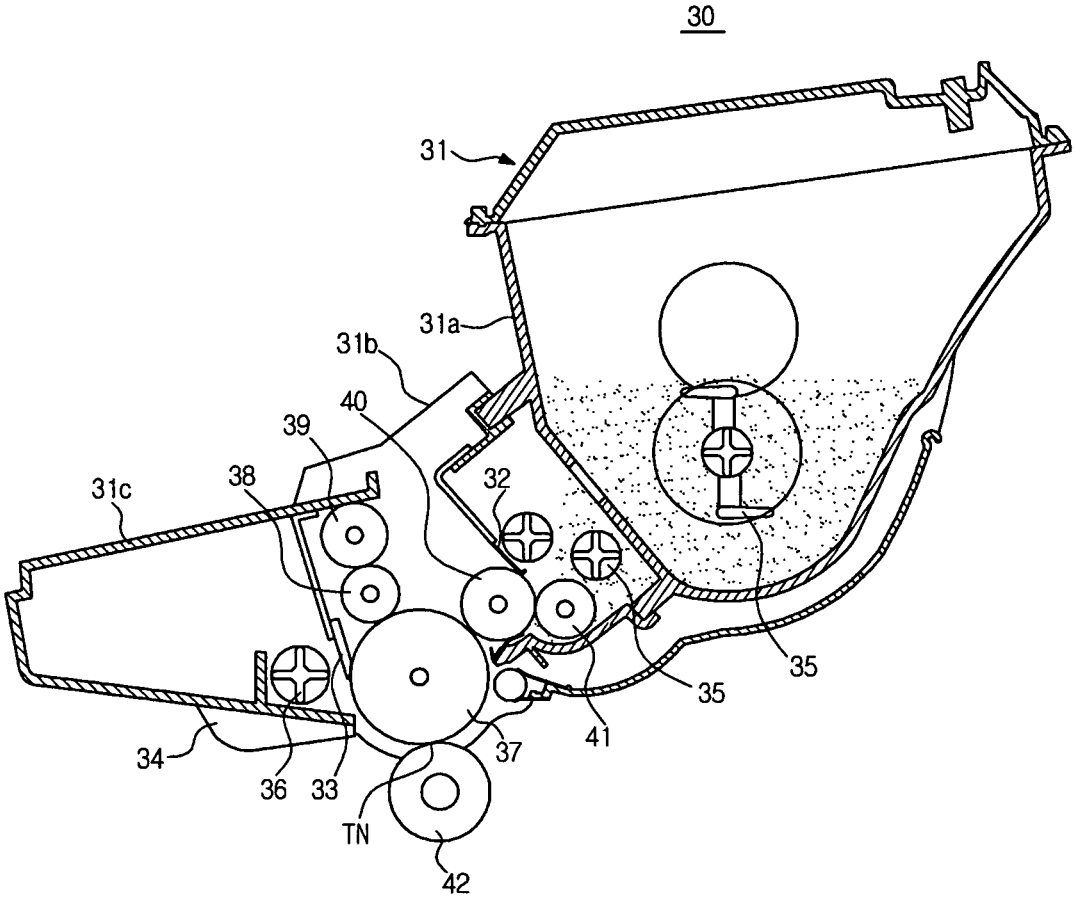
FIG. 2 is a sectional view illustrating a configuration of a developing unit usable with the image forming apparatus according to the embodiment.

FIG. 1 is a sectional view illustrating a configuration of an image forming apparatus according to an embodiment, and FIG. 2 is a sectional view illustrating a configuration of a developing unit usable with the image forming apparatus according to the embodiment.

As shown in FIG. 1, the image forming apparatus 10 according to the embodiment includes a body 11 defining an exterior appearance of the image forming apparatus 10, in which a paper supply unit 20, a developing unit 30, a fusing unit 50 and a paper discharge unit 60 are arranged on a printing path S of a printing medium M.

The paper supply unit 20 serves to store and supply the printing medium M and is arranged below the body 11 to supply the printing medium M toward the developing unit 30.

The paper supply unit 20 may include a paper supply tray 21 in the form of a cassette, the paper supply tray 21 being pushed into or pulled out of the body 11 for storage of the printing medium M, and a delivery unit 27 to pick up the printing medium M stored in the paper supply tray 21 sheet by sheet so as to transmit the printing medium M toward the developing unit 30.

A knock-up plate 23 may be arranged in the paper supply tray 21 to guide the printing medium M loaded thereon toward the delivery unit 27. For this, one end of the knock-up plate 23 may be rotatably coupled to the bottom of the knock-up plate 23 and the other end of the knock-up plate 23 may be supported on a pressure spring 25.

The delivery unit 27 includes a pickup member 28 to pick up the printing medium M loaded on the knock-up plate 23 sheet by sheet, and a roller-shaped feed member 29 to deliver the printing medium M picked up by the pickup member 28 toward the developing unit 30.

The developing unit 30 is located on the printing path S above the paper supply unit 20 and forms an image on the printing medium M delivered from the paper supply unit 20.

The developing unit 30, as shown in FIG. 2, may include a housing 31 defining an exterior appearance of the developing unit 30, in which main elements required to develop an image, such as a photosensitive body 37, a charging roller 38, a cleaning roller 39, a developing roller 40, a supply roller 41, etc., may be received. Accordingly, the housing 31 may take the form of a single process cartridge.

The housing 31 may be divided into a developing part 31*b*, a developer supply part 31*a*, and a waste developer storage part 31*c*. The developing part 31*b* receives processing members to form an image on the printing medium M, the developer supply part 31*a* supplies developer stored therein to the developing part 31*b*, and the waste developer storage part 31*c* stores waste developer collected from the developing part 31*b*.

The developer supply part 31*a* may receive rotating members 35, which serve not only to agitate developer stored in the developer supply part 31*a*, but also to supply the developer to the developing part 31*b*. The developer supply part 31*a* may be integrated with or detachably coupled to the housing 31.

The developing part 31*b* may receive the photosensitive body 37 on which an electrostatic latent image is formed, the charging roller 38 to charge the photosensitive body 37 with a predetermined electric potential, the cleaning roller 39 to remove contaminants attached to a surface of the charging roller 38, the developing roller 40 to develop the electrostatic latent image formed on the photosensitive body 37 into a developer image, and the supply roller 41 to supply the developer from the developer supply part 31*a* to the developing roller 40.

The photosensitive body 37 may serve as an image carrier containing a developer image and may have a drum shape. As a light scanning unit 70 (see FIG. 1) irradiates light, such as laser beam, to the photosensitive body 37 according to image information, an electrostatic latent image is formed on a surface of the photosensitive body 37.

The charging roller 38 charges the surface of the photosensitive body 37 with a predetermined electric potential while being rotated in frictional contact with the surface of the photosensitive body 37.

The developing roller 40 develops the electrostatic latent image formed on the photosensitive body 37 into a developer image by supplying the developer to the photosensitive body 37. The developing roller 40 may supply the developer to the photosensitive body 37 in a contact or non-contact manner.

The supply roller 41 supplies the developer stored in the developer supply part 31*a* to the developing roller 40. The developer supplied to the developing roller 40 may define a constant thickness of developer layer via operation of a regulating member 32.

Accordingly, after the light scanning unit 70 forms an electrostatic latent image on the surface of the photosensitive body 37 which has been charged with a predetermined electric potential by the charging roller 38, the developer stored in the developer supply part 31*a* is supplied to the electrostatic latent image via the supply roller 41 and the developing roller 40, developing the electrostatic latent image into a developer image. In this way, a visible image made of developer powder is formed on the photosensitive body 37.

A transfer roller 42 is installed in the body 11 and serves to transfer the visible image formed on the photosensitive body 37 to a surface of the printing medium M by pressing the printing medium M toward the photosensitive body 37.

The transfer roller 42 is located to come into contact with the photosensitive body 37 of the developing unit 30 when the developing unit 30 is mounted into the body 11. A transfer nip TN is defined at a contact point between the photosensitive body 37 and the transfer roller 42.

Figure 3:
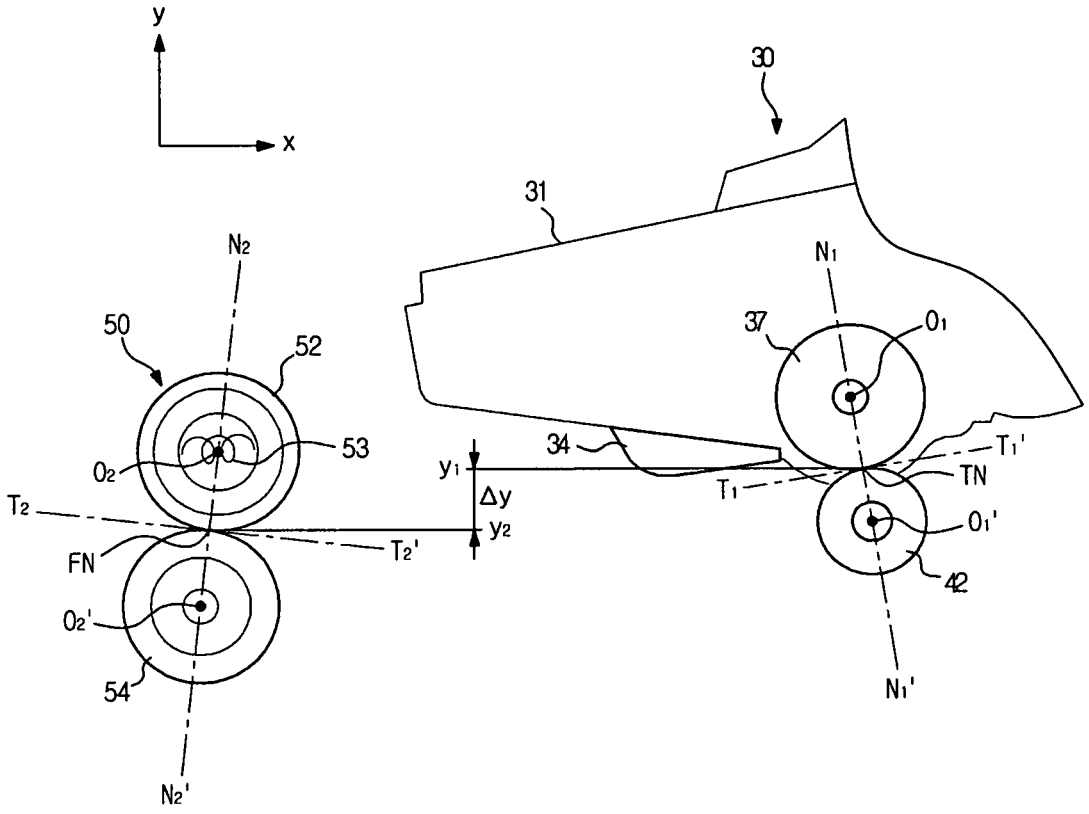
FIGS. 3 and 4 are views illustrating relationship between the developing unit and a fusing unit of the image forming apparatus according to the embodiment.

The transfer nip TN, as shown in FIG. 3, is defined on a common normal $N_1N_1'$ perpendicular to a common tangent $T_1T_1'$ at a contact point of the drum-shaped photosensitive body 37 and the transfer roller 42 which have relative rolling motion while coming into contact with each other.

Accordingly, when the printing medium M passes through between the photosensitive body 37 and the transfer roller 42, the visible image of the photosensitive body 37 is transferred to the printing medium M by the transfer nip TN.

Referring to FIG. 2, the waste developer storage part 31*c* may receive a rotating member 36 to agitate or deliver the developer that has been removed from the photosensitive body 37 by a cleaning blade 33 and collected from the developing part 31*b*. The waste developer storage part 31*c* may be integrated with or detachably coupled to the housing 31.

The printing medium M, which has been passed through the developing unit 30 and has been formed with the visible image, as shown in FIG. 1, is guided to the fusing unit 50 via a guide member 12 located on the horizontal printing path S.

An input guide 51 may be installed at an entrance of the fusing unit 50 to guide the printing medium M to be introduced into the fusing unit 50.

The fusing unit 50 serves to heat and fuse the visible image transferred to the printing medium M, and includes a heating member 52 in which a heating source 53 is installed, and a press roller 54 to press the printing medium M toward the heating member 52.

The heating member 52 may be made of a material having rigidity greater than that of the press roller 54.

The heating source 53 may be a heat-emitting body to heat the heating member 52, such as a heater, heat-emitting lamp, hot wire, etc.

The heating member 52 may take the form of a roller in which the heating source 53 is installed, or may take the form of a belt to be heated by the heating source 53.

The press roller 54 is supported by an elastic member 55, so that a constant fusing pressure is kept between the press roller 54 and the heating member 52 which come into close contact with each other. If necessary, a plurality of press rollers 54 may be provided.

Accordingly, as the fusing unit 50 applies heat and pressure to the visible image transferred to the printing medium M when the printing medium M passes through between the heating member 52 and the press roller 54, the visible image is fused to the printing medium M.

Specifically, as shown in FIG. 3, a fusing nip FN is defined at a contact point between the heating member 52 and the press roller 54. The fusing nip FN causes the press roller 54 having lower rigidity to be pressed so as to come into close contact with the heating member 52.

The fusing nip FN is defined on a common normal $N_2N_2'$ perpendicular to a common tangent $T_2T_2'$ at a contact point of the heating member 52 and the press roller 54 which have relative rolling motion while coming into contact with each other.

The common tangent $T_2T_2'$ indicates a longitudinal direction of the printing path S along which the printing medium M having passed through the developing unit 30 approaches the fusing unit 50.

In the meantime, as shown in FIG. 1, the developing unit 30 and the fusing unit 50 are arranged on the printing path S to horizontally face each other. In addition, the printing medium M, having passed through the fusing unit 50, is moved upward from the fusing unit 50 along the printing path S, thereby being discharged out of the body 11.

In other words, in the image forming apparatus 10 of the present embodiment, the printing path S, along which the printing medium M moves from the paper supply unit 20 to the outside of the body 11, is an approximately S-shaped path.

In this case, in a state wherein the printing medium M is located on the printing path S between the developing unit 30 and the fusing unit 50 which are arranged to horizontally face each other within the body 11, the visible image present on the printing medium M is in a non-fused state.

In addition, fine developer powder may be present on a lower surface 31*d* of the housing 31 of the developing unit 30.

When the printing medium M, having passed through the developing unit 30, is delivered toward the fusing unit 50 to pass between the heating member 52 and the press roller 54, the press roller 54 having lower rigidity is pressed and deformed by compressive force acting between the heating member 52 and the press roller 54.

With this deformation of the fusing nip FN, the printing medium M, having passed through the transfer nip TN of the developing unit 30, may slightly escape from the printing path S extending to the fusing unit 50, causing a rear end of the printing medium M to be raised from the printing path S.

To prevent image pollution caused when the raised rear end of the printing medium M comes into contact with the lower surface 31*d* of the housing 31 of the developing unit 30, guide ribs 34 may be provided at opposite sides of the lower surface 31*d* of the housing 31.

The image forming apparatus 10 of the present embodiment has a configuration to prevent the rear end of the printing medium M from being raised while the printing medium M passes through the fusing unit 50 and consequently, from coming into contact with the lower surface 31*d* of the housing 31 of the developing unit 30.

Referring to FIG. 3, the developing unit 30 and the fusing unit 50 are arranged to horizontally face each other within the body 11.

The printing path S for delivery of the printing medium M between the developing unit 30 and the fusing unit 50, as shown in FIG. 1, includes a downward slope and an upward slope, which are sequentially arranged in an advance direction of the printing medium M. The downward slope guides the printing medium M immediately having passed through the developing unit 30 and the upward slope guides the printing medium M approaching the fusing unit 50.

Accordingly, after passing through the developing unit 30, the printing medium M is delivered downward of the housing 31 of the developing unit 30. Then, after passing through the fusing unit 50, the printing medium M is delivered upward of the body 11, so as to be discharged out of the body 11.

As shown in FIG. 3, with respect to an x-axis direction, a center $O_1$ of the photosensitive body 37 of the developing unit 30 is closer to the fusing unit 50 than a center $O_1'$ of the transfer roller 42, and a center $O_2$ of the heating member 52 of the fusing unit 50 is closer to the developing unit 30 than a center $O_2'$ of the press roller 54.

Although FIG. 3 illustrates the photosensitive body 37 of the developing unit 30 as being located above the transfer roller 42 and the heating member 52 of the fusing unit 50 as being located above the press roller 54, on the contrary, the transfer roller 42 and the press roller 54 may be upper rollers.

In this case, with respect to an x-axis direction, the center $O_1'$ of the transfer roller 42 may be closer to the fusing unit 50 than the center $O_1$ of the photosensitive body 37, and the center $O_2'$ of the press roller 54 may be closer to the developing unit 30 than the center $O_2$ of the heating member 52.

A position $y_1$ of the transfer nip TN of the developing unit 30 may be remarkably higher than a position $y_2$ of the fusing nip FN of the fusing unit 50.

In other words, the position of the transfer nip TN and the position of the fusing nip FN may have a height difference $\Delta y$ in a y-axis direction.

With the height difference $\Delta y$, as shown in FIG. 3, it may be possible to prevent the rear end of the printing medium M from being raised from the printing path S when the printing medium M approaches the fusing unit 50 and consequently, from coming into contact with the lower surface 31*d* of the housing 31 of the developing unit 30.

Figure 4:
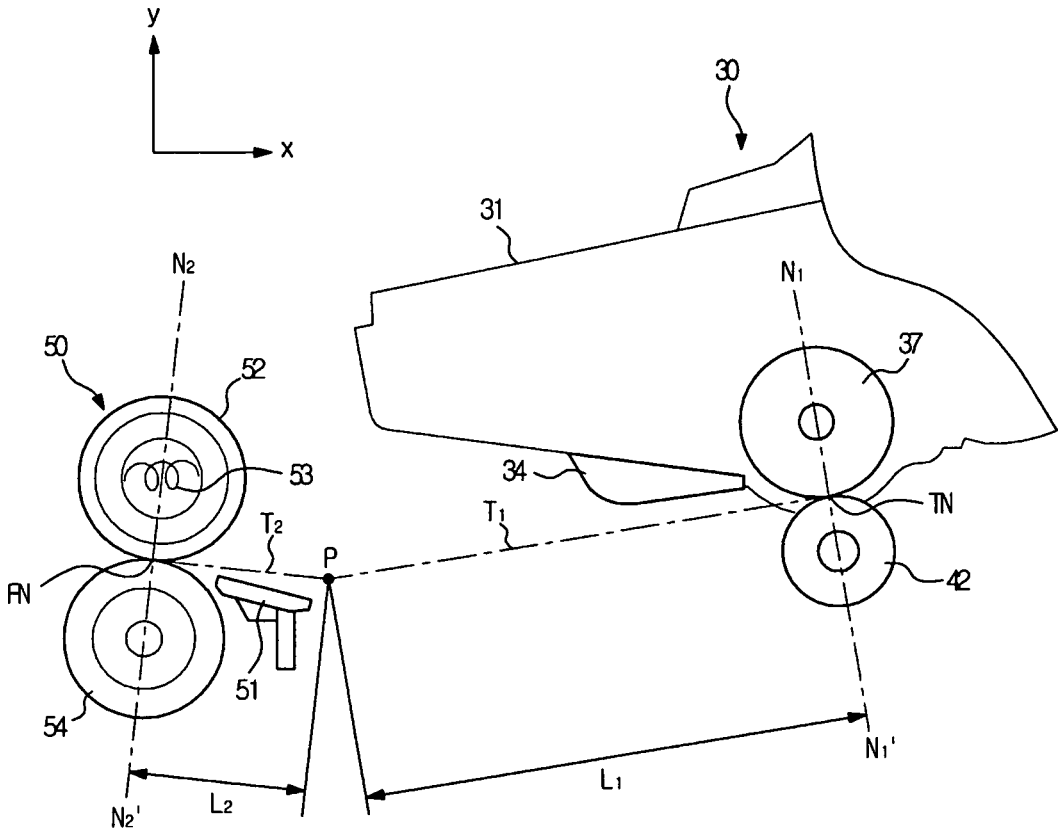

FIG. 4 illustrates relationship between the transfer nip and the fusing nip of the image forming apparatus according to the embodiment.

In one example with respect to the height difference $\Delta y$ to prevent the rear end of the printing medium M from coming into contact with the lower surface 31*d* of the housing 31 due to deformation of the fusing nip FN, as shown in FIG. 4, the transfer nip TN of the developing unit 30 is located higher than the fusing nip FN of the fusing unit 50 in a y-axis direction.

Assuming a transfer nip tangent $T_1$ as an extension of the common tangent of the photosensitive body 37 and the transfer roller 42 and a fusing nip tangent $T_2$ as an extension of the common tangent of the heating member 52 and the press roller 54, the fusing nip FN of the fusing unit 50 is closer to an intersection point P, where the transfer nip tangent $T_1$ and the fusing nip tangent $T_2$ meet, than the transfer nip TN of the developing unit 30.

In addition, a length $L_1$ of the transfer nip tangent $T_1$ between the transfer nip TN and the intersection point P may be longer than a length $L_2$ of the fusing nip tangent $T_2$ between the fusing nip FN and the intersection point P.

Although the length $L_1$ of the transfer nip tangent $T_1$ may be equal to or greater than 1.5 times or equal to or less than 3 times the length $L_2$ of the fusing nip tangent $T_2$, the length $L_1$ is advantageously twice the length $L_2$.

The distance between the transfer nip TN and the fusing nip FN is limited due to a limited paper size. Accordingly, if the length $L_1$ of the transfer nip tangent $T_1$ is greater than 3 times the length $L_2$ of the fusing nip tangent $T_2$, the printing medium M may directly enter the fusing nip FN of the fusing unit 50, causing delivery faults.

On the other hand, if the length $L_1$ of the transfer nip tangent $T_1$ is less than 1.5 times the length $L_2$ of the fusing nip tangent $T_2$, the printing medium M entering the fusing nip FN may have an angular difference from the fusing nip FN rather than being aligned with the fusing nip FN. This may make it difficult for the printing medium M to come into contact with the input guide 51, hindering smooth entrance of the printing medium M.

With the above described configuration, while the printing medium M having passed through the developing unit 30 is delivered to the fusing unit 50 so as to pass through the fusing nip FN, it may be possible to prevent the rear end of the printing medium M from coming into contact with the lower surface 31*d* of the housing 31 of the developing unit 30 even if the rear end of the printing medium M discharged from the transfer nip TN is raised due to deformation of the fusing nip FN.

In this case, although the guide ribs 34 provided at opposite sides of the lower surface of the housing 31 push edges of the printing medium M thus serving to prevent pollution of the image on the printing medium M, the guide ribs 34 are allowed only to come into contact with the edges of the printing medium M where no image has been transferred. Therefore, the guide ribs 34 may have difficulty preventing a partial region of the printing medium M between the guide ribs 34 from coming into contact with the lower surface 31*d* of the housing 31.

Accordingly, with the relationship between the transfer nip TN and the fusing nip FN of the present embodiment, it may be possible to prevent image pollution caused when the rear end of the printing medium M comes into contact with the lower surface of the housing 31 of the developing unit 30.

In addition, with the relationship between the transfer nip TN and the fusing nip FN of the present embodiment, it may be possible to completely prevent the rear end of the printing medium M from coming into contact with the lower surface of the housing 31 of the developing unit 30 due to deformation of the fusing nip FN. This may eliminate a need for anti-pollution elements such as the guide ribs 34.

The printing medium M, which has passed through the fusing unit 50 and has been formed with the visible image, as shown in FIG. 1, is discharged upward out of the body 11 via the paper discharge unit 60.

The paper discharge unit 60 may include a first discharge roller 61 and a second discharge roller 63 arranged above the fusing unit 50 to define the 'S'-shaped printing path S.

The image forming apparatus 10 may further include a double-sided printing unit 80 to return the printing medium M, on a surface of which the image has been completely formed, to the developing unit 30.

The double-sided printing unit 80 returns the printing medium M, on a surface of which the image has been completely formed, to the developing unit 30, so as to enable printing of both surfaces of the printing medium M.

The double-sided printing unit 80 includes a double-sided printing guide 81 to define a return path of the printing medium M, and a series of return rollers 83 installed on the return path of the printing medium M to deliver the printing medium M.

To perform a double-sided printing operation, after inverting the printing medium M, on one surface of which an image has been completely formed, at a predetermined time while moving the printing medium M by the second discharge roller 63, the inverted printing medium M is guided to the double-sided printing guide 81 and is returned to the developing unit 30 by the return rollers 83. As the returned printing medium M sequentially passes through the developing unit 30 and the fusing unit 50, another image is formed on the other surface of the printing medium M.

As is apparent from the above description, an image forming apparatus according to the embodiment may prevent image pollution caused when a rear end of a printing medium comes into contact with a developing unit due to deformation of a fusing nip, achieving enhanced reliability.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

a body;

a transfer nip defined by a photosensitive body on which an electrostatic latent image is formed and a transfer roller used to transfer a visible image formed on the photosensitive body to a printing medium;

a fusing nip defined by a heating member having a heating source and a press roller adapted to press the printing medium toward the heating member, wherein the transfer nip and the fusing nip are horizontally arranged so that the fusing nip is located lower than the transfer nip, and the fusing nip is provided to deliver the printing medium upward, and wherein a printing path, along which the printing medium is delivered, between the transfer nip and the fusing nip includes a guide unit having a downward slope to guide the printing medium immediately having passed through the transfer nip and an upward slope to guide the printing medium approaching the fusing nip; and two guide ribs that are each provided at only opposite sides of the lower surface of a housing of a developing unit to push the edges the of the printing medium to prevent the printing medium from coming into contact with the housing, wherein the two guide ribs are allowed only to come into contact with the edges of the printing medium where none of the visible image is transferred, wherein the image forming apparatus further comprising an intersection point where a common tangent of the transfer nip and a common tangent of the fusing nip meet, and wherein a length of a fusing nip tangent between the fusing nip and the intersection point is shorter than a length of a transfer nip tangent between the transfer nip and the intersection point, and the length of the transfer nip tangent and the length of the fusing nip tangent satisfy the following relation:

$$1.5 \leq L1/L2 \leq 2.0$$

where, L1 is the length of the transfer nip tangent, and L2 is the length of the fusing nip tangent.

2. The apparatus according to claim 1, wherein the fusing nip is closer to an intersection point, where a common tangent of the transfer nip and a common tangent of the fusing nip meet, than the transfer nip.

3. The apparatus according to claim 1, wherein an upper one of centers of the heating member and the press roller defining the fusing nip is arranged closer to the transfer nip than a lower one with respect to an x-axis direction.

4. The apparatus according to claim 1, wherein an upper one of centers of the photosensitive body and the transfer roller defining the transfer nip is arranged closer to the fusing nip than a lower one with respect to an x-axis direction.

5. The apparatus according to claim 1, further comprising a paper supply unit provided in a lower region of the body for storage and supply of the printing medium.

6. The apparatus according to claim 1, further comprising a paper discharge unit provided above the fusing nip to discharge the printing medium, having passed through the fusing nip, out of the body.

7. The apparatus according to claim 1, wherein the heating source is a heating roller.

8. An image forming apparatus comprising:

a body;

a paper supply unit to store and supply a printing medium;

a transfer nip defined at a contact region between a photosensitive drum, on which an electrostatic latent image is formed, and a transfer roller used to transfer a visible image formed on the photosensitive drum to the printing medium;

a fusing nip located lower than the transfer nip and defined at a contact region between a heating roller and a press roller adapted to press the printing medium toward the heating roller;

a paper discharge unit to discharge the printing medium, having passed through the fusing nip, out of the body, wherein the fusing nip is closer to an intersection point, where a tangent of the transfer nip and a tangent of the fusing nip meet, than the transfer nip, and wherein a printing path, along which the printing medium is delivered, between the transfer nip and the fusing nip includes a guide unit having a downward slope to guide the printing medium immediately having passed through the transfer nip and an upward slope to guide the printing medium approaching the fusing nip, wherein the fusing nip is provided to deliver the printing medium upward after having passed through the fusing nip; and two guide ribs that are each provided at only opposite sides of the lower surface of a housing of a developing unit to push the edges the of the printing medium to prevent the printing medium from coming into contact with the housing, wherein the two guide ribs are allowed only to come into contact with the edges of the printing medium where none of the visible image is transferred, wherein the image forming apparatus further comprising an intersection point where a common tangent of the transfer nip and a common tangent of the fusing nip meet, and wherein a length of a fusing nip tangent between the fusing nip and the intersection point is shorter than a length of a transfer nip tangent between the transfer nip and the intersection point, and the length of the transfer nip tangent and the length of the fusing nip tangent satisfy the following relation:

$$1.5 \leq L1/L2 \leq 2.0$$

where, L1 is the length of the transfer nip tangent, and L2 is the length of the fusing nip tangent.

9. The apparatus according to claim 8, wherein the paper supply unit is arranged in a lower region of the body, and the paper discharge unit is arranged in an upper region of the body.

10. The apparatus according to claim 9, wherein a printing path of the printing medium is an 'S'-shaped path.

11. An image forming apparatus comprising:

a transfer nip defined by a photosensitive drum and a transfer roller;

a fusing nip defined by a heating roller and a press roller, wherein the transfer nip and the fusing nip are horizontally arranged so that the fusing nip is located lower than the transfer nip, and an upper one of centers of the heating roller and the press roller defining the fusing nip is arranged closer to the transfer nip than a lower one with respect to an x-axis direction, and wherein a printing path, along which the printing medium is delivered, between the transfer nip and the fusing nip includes a guide unit having a downward slope to guide the printing medium immediately having passed through the transfer nip and an upward slope to guide the printing medium approaching the fusing nip, wherein the fusing nip is provided to deliver the printing medium upward after having passed through the fusing nip; and two guide ribs that are each provided at only opposite sides of the lower surface of a housing of a developing unit to push the edges the of the printing medium to prevent the printing medium from coming into contact with the housing, wherein the two guide ribs are allowed only to come into contact with the edges of the printing medium where none of the visible image is transferred, wherein the image forming apparatus further comprising an intersection point where a common tangent of the transfer nip and a common tangent of the fusing nip meet, and wherein a length of a fusing nip tangent between the fusing nip and the intersection point is shorter than a length of a transfer nip tangent between the transfer nip and the intersection point, and the length of the transfer nip tangent and the length of the fusing nip tangent satisfy the following relation:

$$1.5 \leq L1/L2 \leq 2.0$$

where, L1 is the length of the transfer nip tangent, and L2 is the length of the fusing nip tangent.

12. The apparatus according to claim 11, wherein an upper one of centers of the photosensitive drum and the transfer roller defining the transfer nip is arranged closer to the fusing nip than a lower one with respect to an x-axis direction.

* * * * *

UNITED STATES PATENT AND TRADEMARK OFFICE

CERTIFICATE OF CORRECTION

PATENT NO. : 8,934,831 B2
APPLICATION NO. : 12/923226
DATED : January 13, 2015
INVENTOR(S) : Dong Ha Choi It is certified that error appears in the above-identified patent and that said Letters Patent is hereby corrected as shown below:

Title page, item (57) Abstract, Line 1

Delete “apparatus,” and insert --apparatus--, therefor.

Title page, item (57) Abstract, Line 2

After “unit” delete “are”.

Claims

Claim 1, Column 9, Line 24

After “edges” delete “the”.

Claim 8, Column 10, Line 28

After “edges” delete “the”.

Claim 11, Column 11, Line 6

After “edges” delete “the”.

Signed and Sealed this
Thirteenth Day of October, 2015

Michelle K. Lee

Michelle K. Lee
*Director of the United States Patent and Trademark Office*